US009115610B2

(12) United States Patent
Tewes et al.

(10) Patent No.: US 9,115,610 B2
(45) Date of Patent: Aug. 25, 2015

(54) SYSTEM FOR VARYING CYLINDER VALVE TIMING IN AN INTERNAL COMBUSTION ENGINE

(71) Applicant: HUSCO Automotive Holdings LLC, Waukesha, WI (US)

(72) Inventors: Allen Tewes, Pewaukee, WI (US); Austin Schmitt, Menomonee Falls, WI (US)

(73) Assignee: HUSCO AUTOMOTIVE HOLDINGS LLC, Waukesha, WI (US)

( * ) Notice: Subject to any disclaimer, the term of this patent is extended or adjusted under 35 U.S.C. 154(b) by 0 days.

(21) Appl. No.: 13/792,396

(22) Filed: Mar. 11, 2013

(65) Prior Publication Data

US 2014/0251247 A1 Sep. 11, 2014

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/3443* (2013.01); *F01L 2001/34489* (2013.01)

(58) Field of Classification Search
CPC ..... F01L 1/3442; F01L 2001/34423; F01L 2001/3445; F01L 2001/34433; F01L 2001/3443; F01L 2001/34426
USPC ..... 123/90.12, 90.17
See application file for complete search history.

(56) References Cited

U.S. PATENT DOCUMENTS

| | | | |
|---|---|---|---|
| 4,762,097 | A | 8/1988 | Baker |
| 5,119,691 | A | 6/1992 | Lichti et al. |
| 6,055,950 | A | 5/2000 | Schafer et al. |
| 6,640,834 | B1 | 11/2003 | Hamkins et al. |
| 6,899,068 | B2 | 5/2005 | Nan et al. |
| 7,000,580 | B1 | 2/2006 | Smith et al. |
| 7,007,925 | B2 | 3/2006 | Nordstrom et al. |
| 7,444,254 | B2 | 10/2008 | Tsukada et al. |
| 7,444,971 | B2 | 11/2008 | Suga et al. |
| 8,205,585 | B2 | 6/2012 | Toda et al. |

(Continued)

FOREIGN PATENT DOCUMENTS

| | | | |
|---|---|---|---|
| GB | 2472054 | A | 1/2011 |
| JP | 2000027611 | A | 1/2000 |
| WO | 2009152880 | A1 | 12/2009 |

OTHER PUBLICATIONS

European Search Report; EP 14157288.3; 5 pages; Jul. 14, 2014.

*Primary Examiner* — Thomas Denion
*Assistant Examiner* — Daniel Bernstein
(74) *Attorney, Agent, or Firm* — Quarles & Brady LLP

(57) ABSTRACT

A variable engine valve timing control system has a cam phase actuator, with first and second actuator ports, to adjust a rotational phase of a camshaft relative to a crankshaft. A first control valve selectively couples the first actuator port to either an engine oil pump or a first valve port. A second control valve selectively couples the second actuator port to either the engine oil pump or a second valve port. Separate check valves prevent oil flow backwards through the first and second control valves from the cam phase actuator to the engine oil pump. In one implementation, the first valve port and second valve port are connected to a fluid reservoir. In another implementation, the first valve port is connected by another check valve to the second actuator port, and the second valve port is connected by a further check valve to the first actuator port.

25 Claims, 2 Drawing Sheets

(56) References Cited

U.S. PATENT DOCUMENTS

| | | | | |
|---|---|---|---|---|
| 8,245,675 | B2 | 8/2012 | Tomimatsu et al. | |
| 8,261,704 | B2 | 9/2012 | Takemura | |
| 8,316,889 | B2 | 11/2012 | Hoppe et al. | |
| 2003/0070713 | A1* | 4/2003 | Cornea et al. | 137/512.15 |
| 2007/0101962 | A1* | 5/2007 | Tsukada et al. | 123/90.17 |
| 2007/0221149 | A1 | 9/2007 | Ruiz | |
| 2007/0251474 | A1 | 11/2007 | Gauthier et al. | |
| 2007/0251477 | A1* | 11/2007 | Nozawa et al. | 123/90.17 |
| 2007/0266976 | A1* | 11/2007 | Nagashima | 123/90.17 |
| 2008/0257288 | A1 | 10/2008 | Takahashi et al. | |
| 2010/0084019 | A1 | 4/2010 | Burke | |
| 2010/0251980 | A1* | 10/2010 | Ushida et al. | 123/90.17 |
| 2011/0005481 | A1 | 1/2011 | Dinkel et al. | |
| 2012/0222634 | A1 | 9/2012 | Dinkel et al. | |

* cited by examiner

SYSTEM FOR VARYING CYLINDER VALVE TIMING IN AN INTERNAL COMBUSTION ENGINE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to variable cylinder valve timing systems for internal combustion engines, and in particular to apparatus for hydraulically operating an actuator that varies a phase relationship between a crankshaft and a cam shaft.

2. Description of the Related Art

Internal combustion engines have a plurality of cylinders containing pistons that are connected to drive a crankshaft. Each cylinder has two or more valves that control the flow of air into the cylinder and the flow of exhaust gases therefrom. The valves were operated by a cam shaft which is mechanically connected to be rotated by the crankshaft. Gears, chains, or belts have been used to couple the crankshaft to the cam shaft. It is important that the valves open and close at the proper times during the combustion cycle of each cylinder. Heretofore, that valve timing relationship was fixed by the mechanical coupling between the crankshaft and the cam shaft.

The fixed setting of the valve timing often was a compromise that produced the best overall operation at all engine operating speeds. However, it has been recognized that optimum engine performance can be obtained if the valve timing varies as a function of engine speed, engine load, and other factors. With the advent of computerized engine control, it became possible to determine the optimum cylinder valve timing based on current operating conditions and in response adjust that timing accordingly.

An exemplary variable cylinder timing system is shown in FIG. 1, in which an engine computer 11 determines the optimum valve timing and applied electric current to a four-way electrohydraulic valve 10 that controls the flow of pressurized oil from a pump 13 to a cam phase actuator 12. The pump 13 typically is the conventional one used to send lubricating oil through the engine. The cam phase actuator 12 couples the cam shaft 14 to a pulley 16 that is driven by a timing belt which engages another pulley on the crankshaft of the engine. Instead of a pulley, a chain sprocket, a gear, or other device may be employed to mechanically couple the cam shaft 14 to the crankshaft. A sensor 21 provides an electrical feedback signal to the engine computer 11 indicating the angular phase of the cam shaft 14.

With additional reference to FIG. 2, the cam phase actuator 12 has a rotor 20 secured to the cam shaft 14. The cam phase actuator 12 has four vanes 22 projecting outward into four chambers 25 in the timing belt pulley 16, thereby defining first and second cavities 26 and 28 in each chamber on opposites sides to the respective vane. A first port 18 in the actuator manifold 15 is connected by a first passageway 30 to the first cavities 26 and a second passageway 33 couples a second port 19 to the second cavities 28.

By selectively controlling the application of engine oil to the first and second ports 18 and 19 of the cam phase actuator 12, the angular phase relationship between the rotating pulley 16 and the cam shaft 14 can be varied to either advance or retard the cylinder valve timing. When the electrohydraulic valve 10 is energized into the center, or neutral, position, fluid from the pump 10 is fed equally into both the first and second cavities 26 and 28 in each timing pulley chamber 25. The equal pressure on both sides of the rotor vanes 22 maintains the present position of those vanes in the pulley chambers 25. The electrohydraulic valve 10 operates in the center position the majority of the time that the engine is running. Note that electric current has to be applied to the electrohydraulic valve 10 to maintain this centered position.

In another position of the electrohydraulic valve 10, pressurized oil from the pump 13 is applied to the first port 18 and other oil is exhausted from the second port 19 to a reservoir 17 (e.g., the oil pan). That pressurized oil is conveyed into the first cavities 26, thereby forcing the rotor 20 clockwise with respect to the timing belt pulley 16 and advancing the valve timing. In yet another position of electrohydraulic valve 10, pressurized oil from the pump is applied to the second port 19, while oil is exhausted from the first port 18 to the reservoir 17. Now pressurized oil is being sent into the second cavities 28, thereby forcing the rotor 20 counterclockwise with respect to the timing belt pulley 16, which retards the valve timing.

References herein to directional relationships and movement, such as left and right, or clockwise and counterclockwise, refer to the relationship and movement of the components in the orientation illustrated in the drawings, which may not be the same for the components as attached to machinery. The term "directly connected" as used herein means that the associated hydraulic components are connected together by a conduit without any intervening element, such as a valve, an orifice or other device, which restricts or controls the flow of fluid beyond the inherent restriction of any conduit. As also used herein, components that are said to be "in fluid communication" are operatively connected in a manner wherein fluid flows between those components.

Operation of the cam phase actuator 12 requires significant oil pressure and flow from the engine oil pump to overcome the torque profile of the cam shaft and adjust the cam timing. In addition, the electrohydraulic valve 10 consumes electric current while placed into the center position the majority of the engine operating time. It is desirable to reduce hydraulic and electrical energy consumption and thereby improve efficiency of the cam phasing system.

SUMMARY OF THE INVENTION

A control system is provided for varying cylinder valve timing of an internal combustion engine that has a pump, a reservoir, a crankshaft, and a camshaft. That system comprises a cam phase actuator for adjusting a rotational phase of the camshaft relative to the crankshaft in response to oil selectively applied to and drained from a first actuator port and a second actuator port.

A first control valve has a first port operatively connected to receive oil from the pump, a second port, and a first workport in fluid communication with the first actuator port of the cam phase actuator. The first control valve has a first position in which a first fluid path is provided between the first port and the first workport, and has a second position in which a second fluid path is provided between the second port and the first workport.

A second control valve has a third port operatively connected to receive oil from the pump, a fourth port, and a second workport in fluid communication with the second actuator port of the cam phase actuator. In one position, the second control valve provides a third fluid path between the third port and the second workport, and in another position provides a fourth fluid path between the fourth port and the second workport.

A first check valve is operatively connected to restrict fluid to flow through the first path only in a direction from the pump to the cam phase actuator. A second check valve is operatively connected to restrict fluid to flow through the third path only in a direction from the pump to the cam phase actuator.

In one implementation of the control system, the second port of the first control valve and the fourth port of the second control valve are in fluid communication with the reservoir.

In another implementation of the control system, the second port of the first control valve is in fluid communication with the second actuator port, and the fourth port of the second control valve is in fluid communication with the first actuator port. In this implementation, a third check valve is operatively connected to restrict fluid to flow only in one direction from the second port to the second actuator port, and a fourth check valve is operatively connected to restrict fluid to flow only in one direction from the fourth port to the first actuator port.

BRIEF DESCRIPTION OF THE DRAWINGS

The following drawings depict examples of variable cam adjustment systems according to the present invention with the understanding that other components and hydraulic circuits may be employed to implement the present invention.

DETAILED DESCRIPTION OF THE INVENTION

Figure 3:
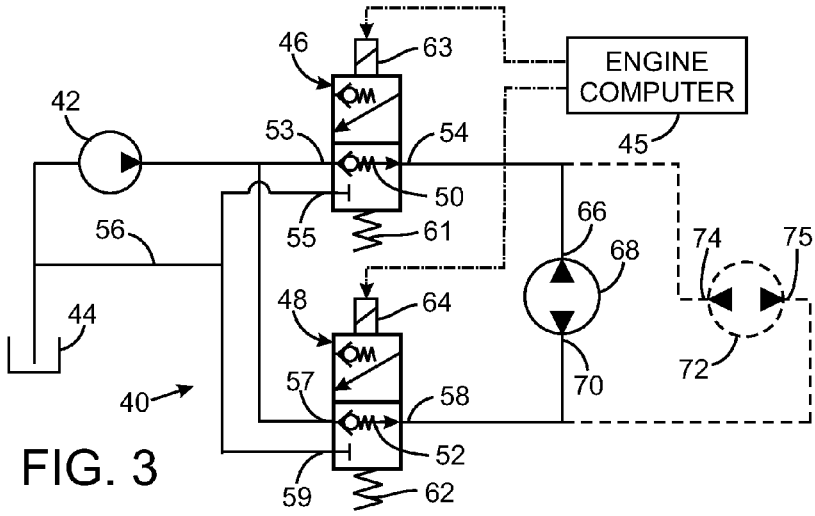
FIG. 3 is a schematic diagram of a first embodiment of a hydraulic circuit according to the present invention.

With initial reference to FIG. 3, a first cam phase control system 40 utilizes oil provided by a conventional oil pump 42 that furnishes oil from a reservoir 44 for lubricating the engine. The outlet of the oil pump 42 is connected to first and second control valves 46 and 48. Each of the control valves 46 and 48 is an electrohydraulic, on/off or proportional, three-way valve that is operated by a signal from an engine computer 45. In one implementation, the engine computer 45 applies a pulse width modulated (PWM) signal to operate an on/off, three-way valve to achieve proportional variation of fluid flow through the valve. Each exemplary control valve 46 or 48 includes an integrated check valve 50 or 52, respectively. The first control valve 46 has a first port 53 that receives oil from the outlet of the oil pump 42, and has a second port in fluid communication with the reservoir 44 via a return line 56. When the first control valve 46 is in a first position as illustrated, a first path is provided between the first port 53 and a first workport 54. A first spring 61 biases the first control valve 46 toward the first position. The first check valve 50 allows oil to flow in the first path only from the first port 53 to the first workport 54 and prevents oil from flowing in the opposite direction. When a first solenoid actuator 63 is activated by an electric current from the engine controller, the first control valve 46 moves into a second position. In that second position, the first control valve 46 provides a bidirectional second path between the first workport 54 and the second port 55 and thus to the reservoir 44.

The second control valve 48 has a third port 57 connected to the outlet of the oil pump 42, and has a fourth port 59 that is connected to the reservoir 44 via the return line 56. In one position of the second control valve 48 that is illustrated, a third path is provided between the third port 57 and a second workport 58. A second spring 62 biases the second control valve 46 toward that one position. Fluid flow through the third path is restricted by the second check valve 52 to only a direction from the third port 57 to a second workport 58. Another position of the second control valve 48 provides a bidirectional fourth fluid path between the second workport 58 and the fourth port 59. An electric current from the engine controller activates a second solenoid actuator 64 to move the second control valve 48 into that other position.

Figure 1:
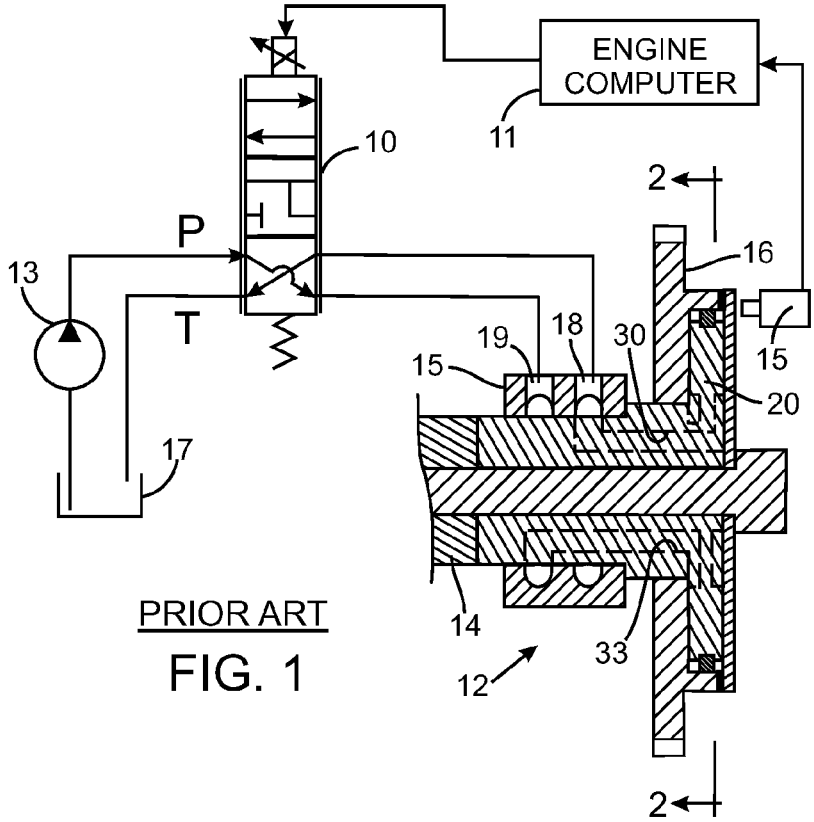
PRIOR ART FIG. 1
FIG. 1 is a schematic diagram of a previous variable cam adjustment system the included a cam phase actuator.
Figure 2:
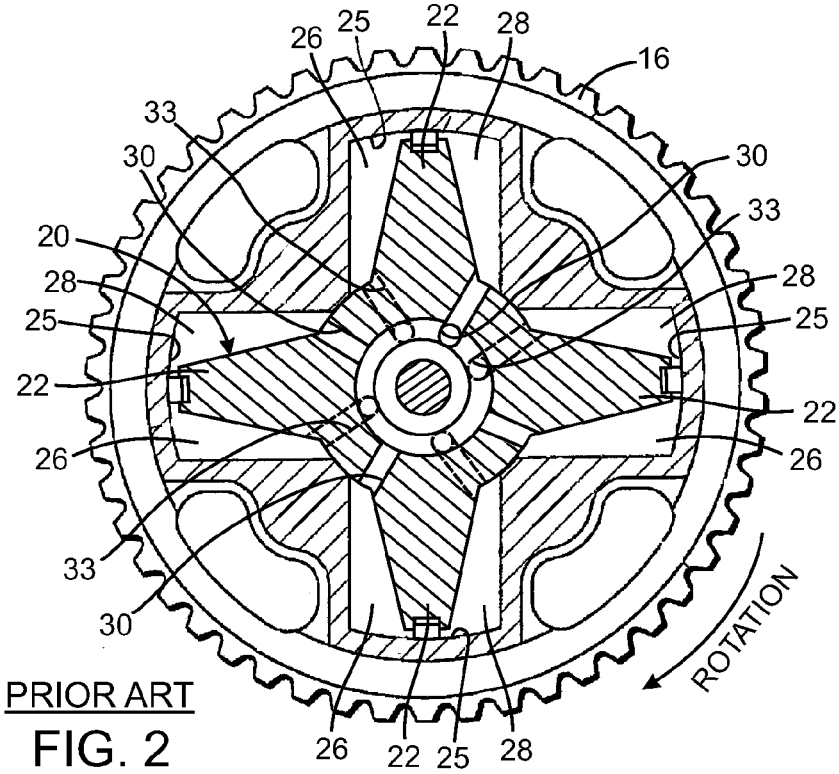
PRIOR ART FIG. 2
FIG. 2 is a cross section view along line 2-2 in FIG. 1 through the cam phase actuator.

The first cam phase control system 40 includes a cam phase actuator 68 for varying the rotational relationship between the crankshaft and the cam shaft of the engine. The cam phase actuator 68 is a conventional, hydraulically operated device used for that purpose and may be similar to the actuator shown in FIGS. 1 and 2. The cam phase actuator 68 has a first actuator port 66 that is directly connected to the first workport 54 of the first control valve 46, and has a second actuator port 70 that is directly connected to the second workport 58 of the second control valve 48.

When the engine computer is not applying current to the first and second solenoid actuators 63 and 64, the two control valves 46 and 48 are biased by the springs 61 and 62 into the positions illustrated in FIG. 3. In that state, equal pressure from the outlet of the oil pump 42 is applied to both actuator ports 66 and 70 of the cam phase actuator 68. Because the first and second check valves 50 and 52 in the first and second control valves 46 and 48 prevent oil from exiting the cam phase actuator 68, the actuator is held in the present phase position, even at slow engine speeds when the pump outlet pressure is low and even when the engine is turned off. Holding the cam phase actuators in the last operating position ensures that appropriate valve timing will be used when the engine is restarted, in spite of an initial slow speed with minimal oil pressure being produced by the pump 42.

De-energizing the first and second control valves 46 and 48 to hold the position of the cam phase actuator 68, as occurs the majority of time while the engine is operating, conserves both electrical power and hydraulic energy from the oil pump. Thus, the present cam phase control system consumes less energy than the previous system that employed a four-way control valve, as in FIG. 1.

Prior cam phase actuators also required a locking mechanism to hold the actuator in a fixed position when the cam phasing was not being adjusted. The first cam phase control system 40 does not require a locking mechanism, because when the cam phase actuator 68 is not being adjusted, the check valves 50 and 52 hold the oil within the cam phase actuator 68 and prevent the change in the cam phase relationship.

With continuing reference to FIG. 3, the first cam phase control system 40 provides bidirectional energy harvesting of cam torque for use in adjusting the cam phasing. This further conserves energy and enables adjustment of the cam phasing at near zero oil supply pressure.

To adjust the cam phase actuator 68 and advance the cylinder valve timing, the first control valve 46 remains de-energized while the second control valve 48 is operated into the position in which the second workport 58 is connected to the fourth port 59 to which the reservoir return line 56 connects. This enables pressurized fluid from the oil pump 42 to be fed into the first actuator port 66 and other fluid to be drained from the second actuator port 70 back to the reservoir 44. This causes the cam phase actuator 68 to change the phase relationship between crank shaft and the cam shaft and thereby advance the cylinder valve timing. When the cam phase reaches the desired angle, as detected by a sensor on the cam phase actuator, engine computer de-energizes the second solenoid actuator 64 which returns the second control valve 48 to the illustrated position in which the adjusted cam phase is maintained.

It should be understood that the engine cylinder valves exert torque onto the cam shaft that tends to alter the position relationship of the components in the cam phase actuator and thus the phase relationship between the crankshaft and the cam shaft. During certain segments of the revolution of the cam shaft, the net torque aids adjusting the cam phase in the desired direction thereby supplementing the adjustment force from the pump pressure. During other revolution segments, the net torque opposes the desired cam phase adjustment. Throughout those latter segments, the cam shaft torque tends to cause the cam phase actuator 68 to push oil backwards through the first control valve 46 to the oil pump 42. For example such backward flow may occur at low engine speeds, when the pump is producing a low output pressure. With the first cam phase control system 40, the first and second check valves 50 and 52 prevent that reverse flow, thereby enabling the system to operate effectively over a wider range of engine conditions, such as low pump output pressure, oil temperatures, and engine speeds. Thus, the present system takes advantage of the net cam shaft torque in rotational direction that aids adjustment of the cam phasing, while inhibiting the effect of adverse cam torque that opposes the desired cam phase adjustment. In other words, the present control system harvests the positive cam torque energy, while preventing the adverse effects of the negative cam torque energy.

This harvesting of cam torque for use in adjusting the cam phasing conserves energy and enables adjustment of the cam phasing at near zero oil supply pressure.

To adjust the cam phase actuator 68 to retard the cylinder valve timing, the first control valve 46 is electrically operated so that the first workport 54 is connected to the second port 55, thereby allowing fluid to be exhausted from the cam phase actuator to the reservoir 44. At the same time, the second control valve 48 is de-energized and thus is biased by the spring 62 into the illustrated position. At that position, oil from the pump 42 is applied to the second workport 58 and the second actuator port 70 of the cam phase actuator 68. In this state, the second check valve 52 enables harvesting of the positive cam torque energy while inhibiting the adverse effects of the negative cam torque energy.

It should be understood with respect to the circuit in FIG. 3 that the check valves 50 and 52 instead of being integrated into the first and second control valves 46 and 48, could be located outside those valves in the conduits that are connected to the respective first and third ports 53 and 57.

Figure 4:
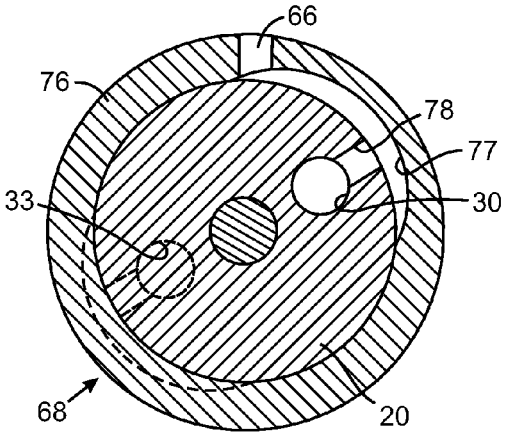
FIG. 4 is a radial cross section view through a cam phase actuator in the first embodiment.

Referring still to FIG. 3, if the engine has dual cam shafts, a second cam phase actuator 72 is provided for the other cam shaft and has actuator ports 74 and 75 connected to the 54 and 58, respectively, of the first and second control valves 46 and 48. The first and second cam phase actuators 68 and 72 are similar to the actuator 12 in FIGS. 1 and 2, except that the first passageway 30 communicates with the first actuator port and the second passageway 33 communicates with the second actuator port, during only a portion of each rotation of the cam shaft 14. With additional reference to FIG. 4 showing details of the first cam phase actuator 68, the first actuator port 66 in the actuator manifold 76 opens into an arcuate recess 77 that extends 90 degrees around the circumference of the bore in which the rotor 20 rotates. A radial aperture 78 in the rotor 20 extends from the outer circumferential surface to first passageway 30 that continues to the first cavities 26. The manifold's arcuate recess 77 and rotor's radial aperture 78 are arranged so that they are in fluid communication when the cam shaft is rotationally positioned between 0 degrees and 90 degrees. The second actuator port 70 of the first cam phase actuator 68 is similarly arranged to be in fluid communication with the second passageway 33, for the second cavities 28, when the cam shaft is between 0 and 90 degrees. One skilled in the art will appreciate that other angles and angle ranges may be used in controlling two or more cam phase actuators.

The second cam phase actuator 72 has a similar design, except that the arcuate recesses 77 are located so that the first and second actuator ports 74 and 75 communicate with the first and second passageways 30 and 33, respectively, when the cam shaft is between 180 degrees and 270 degrees during each rotation. Because of that angular offset of the arcuate recesses, the first and second cavities 26 and 28 of the first cam phase actuator 68 are actively connected to the control valve workports 54 and 58 at different times during each rotation of the cam shafts than when the first and second cavities 26 and 28 of the second cam phase actuator 72 are actively connected to the control valve workports. This enables the cam shaft phasing provided by the two cam phase actuators 68 and 72 to be controlled separately. When the dual cam shafts are between 0 degrees and 90 degrees, the control valves 46 and 48 are operated by the engine computer to vary the phasing of the first cam phase actuator 68; and when the dual cam shafts are between 180 degrees and 270 degrees, the control valves are operated to vary the phasing of the second cam phase actuator 72.

Figure 5:
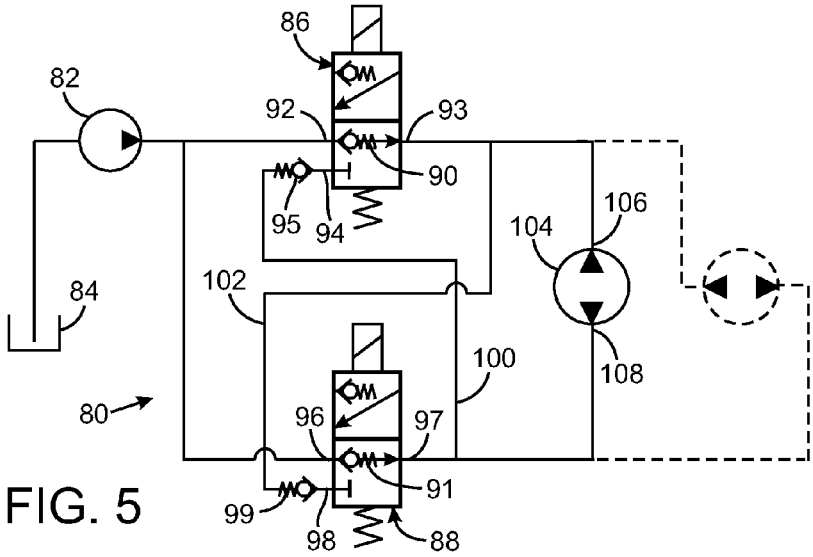
FIG. 5 is a schematic diagram of a second embodiment of a hydraulic circuit according to the present invention.

Referring to FIG. 5, a second embodiment of the present control system provides regeneration using fluid being exhausted from the cam phase actuator. This regenerative circuit reduces the amount of oil flow required from the pump to only that which is needed to replace fluid that leaks from the cam phase actuator and the control valves into the engine.

In the second cam phase control system 80, the conventional oil pump 82 feeds fluid from a reservoir 84 (e.g. the engine oil pan) to a pair of electrohydraulic, three-way control valves 86 and 88. The outlet of the oil pump 82 is connected to a first port 92 of the first control valve 86, that also has a second port 94 and a first workport 93. The first workport 93 is directly connected to a first actuator port 106 of a cam phase actuator 104 and the second port 94 is coupled to a second actuator port 108 by a first regeneration line 100. A third check valve 95 allows oil to flow through the first regeneration line 100 only in a direction from second port 94 to the second actuator port 108.

The outlet of the oil pump 82 also is connected to a third port 96 of the second control valve 88, that has a fourth port 98 and a second workport 97 as well. The second workport 97 is directly connected to the second actuator port 108 of the cam phase actuator 104, and the fourth port 98 is coupled to the first actuator port 106 by a second regeneration line 102. A fourth check valve 99 permits oil to flow through the second regeneration line 102 only in a direction from fourth port 98 to the first actuator port 106.

If the engine has multiple cam shafts, separate cam phase actuators are provided for each cam shaft and such actuators are coupled to the workports 93 and 97 of the two control valves 86 and 88 in the same manner as for the cam phase actuator 104.

When the two control valves 86 and 88 are de-energized, the second cam phase control system 80 functions the same as the first cam phase control system 40 when the both its control valves 46 and 48 are de-energized. When it is desired to advance the cylinder valve timing, the first control valve 86 remains de-energized and the second control valve 88 is electrically operated into the position that connects the second workport 97 to the fourth port 98. In this state, pressurized oil from the oil pump 82 is applied through the first control valve 86 to the first actuator port 106 of the cam phase actuator 104. At the same time, oil flows out of the second actuator port 108 through the second control valve 88, the fourth check valve 99, and the second regeneration line 102. The oil flowing through the second regeneration line 102 combines with the oil from the pump which is flowing out of the first workport 93. Therefore, the oil being exhausted from the second actuator port 108 is supplied in a regenerative manner to the first actuator port 106, thereby reducing the amount of flow required from the oil pump 82 to operate the cam phase actuator 104. This hydraulic regeneration reduces the amount energy consumed by the oil pump 82. In addition, the oil pump 82 does not have to be significantly increased in size, over that required to effectively lubricate the engine, in order for the pump also to supply the second cam phase control system 80.

Similarly, when it is desired to retard the cylinder valve timing, the first control valve 86 is energized to the position in which the first workport 93 is connected to the second port 94. At the same time, the second control valve 88 is maintained de-energized to provide a path that conveys pump output oil from the third port 96 to the second workport 97. In this mode of operation, oil exhausting from the first actuator port 106 of the cam phase actuator 104 is fed back in a regenerative manner through the first control valve 86, the third check valve 95 and the first regeneration line 100 to the second actuator port 108. That regenerative flow combines with any additional flow required from the oil pump 82 that is conveyed through the second control valve 88, to actuate the cam phase actuator 104.

The second embodiment in FIG. 5 could be varied by providing regeneration to only one of the actuator ports 106 or 108, but not to the other actuator port. For example, the first regeneration line 100 could be replaced by a line connecting the second port 94 of the first control valve 86 to the reservoir 84. In this variation, the flow out of the second port 94 is returned to the reservoir 84, while the flow out of the fourth port 98 of the second control valve 88 still flows through the second regeneration line 102 to the first actuator port 106.

The foregoing description was primarily directed to one or more embodiments of the invention. Although some attention has been given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A control system for varying cylinder valve timing of an internal combustion engine that has a pump, a reservoir, a crankshaft, and a camshaft; said control system comprising:

a cam phase actuator for adjusting a rotational phase of the camshaft relative to the crankshaft and having a first actuator port and a second actuator port;

a first control valve comprising a first port operatively connected to receive fluid from the pump, a second port in fluid communication with the second actuator port, and a first workport in fluid communication with the first port of the cam phase actuator, the first control valve having a first position in which a first fluid path is provided between the first port and the first workport, and having a second position in which a second fluid path is provided between the second port and the first workport;

a second control valve comprising a third port operatively connected to receive fluid from the pump, a fourth port in fluid communication with the first actuator port, and a second workport in fluid communication with the second actuator port, the second control valve having one position in which a third fluid path is provided between the third port and the second workport, and having another position in which a fourth fluid path is provided between the fourth port and the second workport;

a first check valve operatively connected to restrict fluid to flow through the first path only in a direction from the pump to the cam phase actuator;

a second check valve operatively connected to restrict fluid to flow through the third path only in a direction from the pump to the cam phase actuator;

a third check valve operatively connected to restrict fluid to flow only in a direction from the second port to the second actuator port; and a fourth check valve operatively connected to restrict fluid to flow only in a direction from the fourth port to the first actuator port.

2. The control system as recited in claim 1 wherein the second port of the first control valve and the fourth port of the second control valve are in fluid communication with the reservoir.

3. The control system as recited in claim 1 wherein the first control valve and the second control valve are both electrically operated valves.

4. The control system as recited in claim 1 further comprising a first spring biasing the first control valve toward the first position; and a second spring biasing the second control valve toward the one position.

5. The control system as recited in claim 1 wherein the first check valve is integrated into the first control valve; and the second check valve is integrated into the second control valve.

6. A control system for varying cylinder valve timing of an internal combustion engine that has a pump, a reservoir, a crankshaft, and a camshaft; said control system comprising:

a cam phase actuator for adjusting a rotational phase of the camshaft relative to the crankshaft and having a first actuator port and a second actuator port;

a first control valve comprising a first port operatively connected to receive fluid from the pump, a second port, and a first workport in fluid communication with the first ort of the cam phase actuator, the first control valve being a three-way valve and having a first position in which a first fluid path is provided between the first workport, and the first workport, and having a second position in which a second fluid path is provided between the second port and the first workport;

a second control valve comprising a third port operatively connected to receive fluid from the pump, a fourth port in fluid communication with the first actuator port, and a second workport, the second control valve being a three-way valve and having one position in which a third fluid path is provided between the third port and the second workport, and having another position in which a fourth fluid path is provided between the fourth port and the second workport;

a first check valve operatively connected to restrict fluid to flow through the first path only in a direction from the pump to the earn phase actuator; and a second check valve operatively connected to restrict fluid to flow through the third path only in a direction from the pump to the cam phase actuator.

7. The control system as recited in claim 6 wherein the first control valve and the second control valve are both electrically operated valves.

8. The control system as recited in claim 6 further comprising a first spring biasing the first control valve toward the first position; and a second spring biasing the second control valve toward the one position.

9. The control system as recited in claim 6 wherein the first check valve is integrated into the first control valve; and the second check valve is integrated into the second control valve.

10. A control system for varying cylinder valve timing of an internal combustion engine that has a pump, a reservoir, a crankshaft, and a camshaft; said control system comprising:

a first cam phase actuator for adjusting a rotational phase of the camshaft relative to the crankshaft and having a first actuator port and a second actuator port;

a first control valve comprising a first port operatively connected to receive fluid from the pump, a second port in fluid communication with the reservoir, and a first workport in fluid communication with the first actuator port, the first control valve being a three-way valve and having a first position in which a first fluid path is provided between the first port and the first workport, and having a second position in which a second fluid path is provided between the second port and the first workport;

a second control valve comprising a third port operatively connected to receive fluid from the pump, a fourth port in fluid communication with the reservoir, and a second workport in fluid communication with the second actuator port, the second control valve being a three-way valve and having one position in which a third fluid path is provided between the third port and the second workport, and having another position in which a fourth fluid path is provided between the fourth port and the second workport;

a first check valve operatively connected to restrict fluid to flow through the first path only in a direction from the pump to the first workport; and a second check valve operatively connected to restrict fluid to flow through the third path only in a direction from the pump to the second workport.

11. The control system as recited in claim 10 wherein the first control valve and the second control valve are both electrically operated valves.

12. The control system as recited in claim 10 further comprising a first spring biasing the first control valve toward the first position; and a second spring biasing the second control valve toward the one position.

13. The control system as recited in claim 10 wherein the first check valve is integrated into the first control valve; and the second check valve is integrated into the second control valve.

14. A control system for varying cylinder valve timing of an internal combustion engine that has a pump, a reservoir, a crankshaft, and a camshaft; said control system comprising:

a first cam phase actuator for adjusting a rotational phase of the camshaft relative to the crankshaft and having a first actuator port and a second actuator port;

a first control valve comprising a first port operatively connected to receive fluid from the pump, a second port in fluid communication with the reservoir, and a first workport in fluid communication with the first actuator port, the first control valve having a first position in which a first fluid path is provided between the first port and the first workport, and having a second position in which a second fluid path is provided between the second port and the first workport;

a second control valve comprising a third port operatively connected to receive fluid from the pump, a fourth port in fluid communication with the reservoir, and a second workport in fluid communication with the second actuator port, the second control valve having one position in which a third fluid path is provided between the third port and the second workport, and having another position in which a fourth fluid path is provided between the fourth port and the second workport;

a first check valve operatively connected to restrict fluid to flow through the first path only in a direction from the pump to the first workport;

a second check valve operatively connected to restrict fluid to flow through the third path only in a direction from the pump to the second workport; and a second cam phase actuator having one actuator port in fluid communication with the first workport and another port in fluid communication with the second workport, wherein phasing of the first cam phase actuator is varied during a first range of angles during rotation of the cam shaft and phasing of the second cam phase actuator is varied during a second range of angles during rotation of the cam shaft.

15. The control system as recited in claim 14 wherein the first control valve and the second control valve are both electrically operated valves.

16. The control system as recited in claim 14 further comprising a first spring biasing the first control valve toward the first position; and a second spring biasing the second control valve toward the one position.

17. The control system as recited in claim 14 wherein the first check valve is integrated into the first control valve; and the second check valve is integrated into the second control valve.

18. A control system for varying cylinder valve timing of an internal combustion engine that has a pump, a reservoir, a crankshaft, and a camshaft; said control system comprising:

a first cam phase actuator for adjusting a rotational phase of the camshaft relative to the crankshaft and having a first actuator port and a second actuator port;

a first control valve comprising a first port operatively connected to receive fluid from the pump, a second port, and a first workport in fluid communication with the first port of the first cam phase actuator, the first control valve having a first position in which a first fluid path is provided between the first port and the first workport, and having a second position in which a second fluid path is provided between the second port and the first workport;

a second control valve comprising a third port operatively connected to receive fluid from the pump, a fourth port, and a second workport in fluid communication with the second actuator port of the first cam phase actuator, the second control valve having one position in which a third fluid path is provided between the third port and the second workport, and having another position in which a fourth fluid path is provided between the fourth port and the second workport;

a first check valve operatively connected to restrict fluid to flow through the first path of the first control valve only in a direction from the pump to the first workport;

a second check valve operatively connected to restrict fluid to flow through the third path of the second control valve only in a direction from the pump to the second workport; and a third check valve providing a path for fluid to flow in a direction only from the second port of the first control valve to the second actuator port.

19. The control system as recited in claim 18 wherein the fourth port of the second control valve is in fluid communication with the reservoir.

20. The control system as recited in claim 18 further comprising a fourth check valve providing a path for fluid to flow in a direction only from the fourth port of the second control valve to the first actuator port.

21. The control system as recited in claim 18 wherein the first control valve and the second control valve are both three-way valves.

22. The control system as recited in claim 18 wherein the first control valve and the second control valve are both electrically operated valves.

23. The control system as recited in claim 18 further comprising a first spring biasing the first control valve toward the first position; and a second spring biasing the second control valve toward the one position.

24. The control system as recited in claim 18 wherein the first check valve is integrated into the first control valve; and the second check valve is integrated into the second control valve.

25. The control system as recited in claim 18 further comprising a second cam phase actuator having one actuator port in fluid communication with the first workport and another actuator port in fluid communication with the second workport, wherein phasing of the first cam phase actuator is varied during a first range of angles during rotation of the cam shaft and phasing of the second cam phase actuator is varied during a second range of angles during rotation of the cam shaft.

* * * * *

UNITED STATES PATENT AND TRADEMARK OFFICE

CERTIFICATE OF CORRECTION

PATENT NO. : 9,115,610 B2
APPLICATION NO. : 13/792396
DATED : August 25, 2015
INVENTOR(S) : Tewes et al.

It is certified that error appears in the above-identified patent and that said Letters Patent is hereby corrected as shown below:

In the Claims

Column 8, Claim 6, line 50, “ort” should be --port--.

Column 8, Claim 6, line 52, “workport” should be --port--.

Signed and Sealed this
Twelfth Day of January, 2016

Michelle K. Lee

Michelle K. Lee
*Director of the United States Patent and Trademark Office*